United States Patent [19]

Casanova

[11] 4,362,337

[45] Dec. 7, 1982

[54] TUNNELING SYSTEM

[75] Inventor: Paul Casanova, Paris, France

[73] Assignee: Techniques Industrielles et Minieres, Paris, France

[21] Appl. No.: 160,459

[22] Filed: Jun. 18, 1980

[30] Foreign Application Priority Data

Jun. 21, 1979 [FR] France ..... 79 15908

[51] Int. Cl.[3] ..... E21D 9/10

[52] U.S. Cl. ..... 299/31; 299/33; 299/76

[58] Field of Search ..... 299/31, 33, 75, 76; 405/295

[56] References Cited

U.S. PATENT DOCUMENTS

| | | | |
|---|---|---|---|
| 1,736,853 | 11/1929 | Fisher | 299/33 X |
| 3,420,577 | 1/1969 | Pentith | 299/31 |
| 3,879,088 | 4/1975 | Sodder et al. | 299/31 |
| 3,966,258 | 6/1976 | Dolecki | 299/76 |
| 4,040,699 | 8/1977 | Franklin | 299/56 |
| 4,232,905 | 11/1980 | Dick | 299/31 |

FOREIGN PATENT DOCUMENTS

| | | | |
|---|---|---|---|
| 648736 | 9/1962 | Canada | 180/6.48 |
| 948232 | 8/1956 | Fed. Rep. of Germany . | |
| 2040286 | 2/1972 | Fed. Rep. of Germany . | |
| 2455016 | 5/1975 | Fed. Rep. of Germany | 405/295 |
| 1118233 | 6/1956 | France . | |
| 1127180 | 12/1956 | France . | |
| 1268468 | 6/1961 | France . | |
| 1276927 | 10/1961 | France . | |
| 1400211 | 4/1965 | France . | |
| 7241314 | 6/1974 | France . | |
| 7604089 | 2/1976 | France . | |
| 7736677 | 6/1976 | France . | |
| 7601961 | 8/1977 | France . | |
| 7730300 | 10/1977 | France . | |
| 7619718 | 1/1978 | France . | |
| 777393 | 6/1957 | United Kingdom . | |
| 977944 | 12/1964 | United Kingdom | 299/75 |

*Primary Examiner*—Ernest R. Purser

*Attorney, Agent, or Firm*—Young & Thompson

[57] ABSTRACT

The system for digging subterranean galeries comprises a cutting tool articulated on a frame and mounted so as to be movable along the height of the mine face. This frame is provided with ground support means and with propulsion means for following the progress of the cutting, the articulation point of the cutting tool being situated in the upper half of the system in operating position. The articulation point of the cutting tool may be situated on a member movable with respect to the frame and movable in a direction substantially parallel to the direction of advance. The shaft bearing the cutting tool may be mounted on two bearings, one of which is movable vertically to give the tool an oblique path in a pre-determined direction.

16 Claims, 21 Drawing Figures

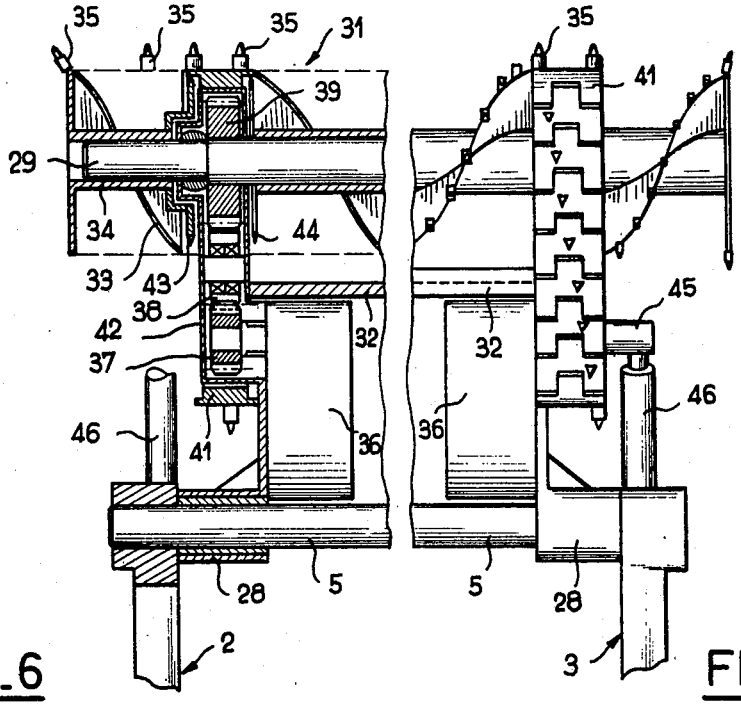
FIG_6
FIG_5
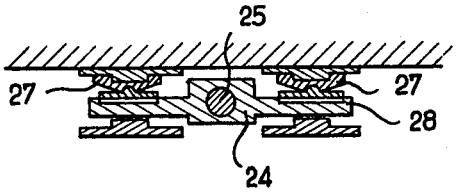
FIG_4
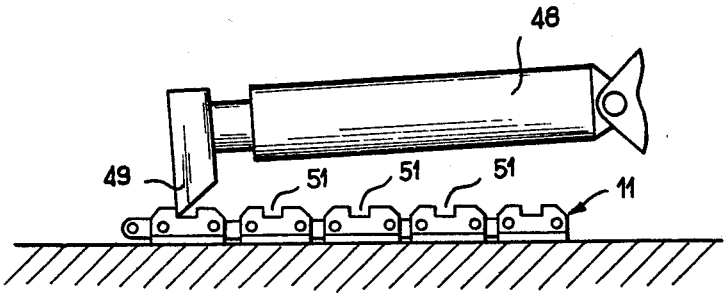
FIG_7

FIG_18
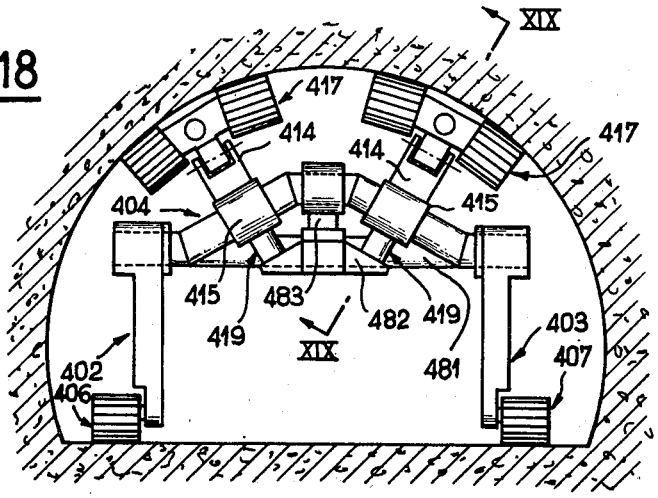
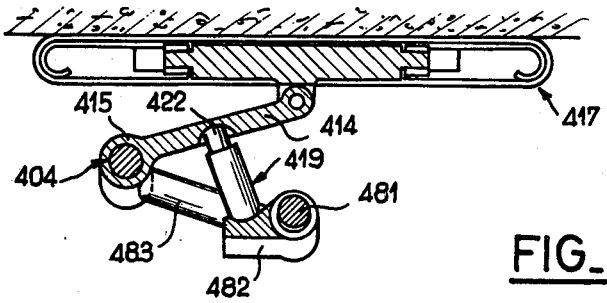
FIG_19
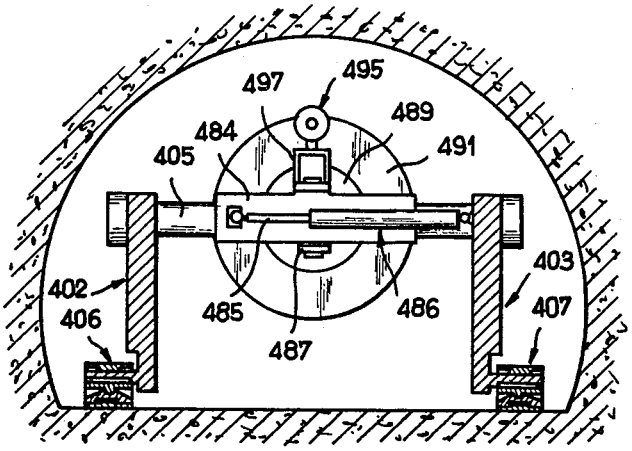
FIG_20

TUNNELING SYSTEM

BACKGROUND AND GENERAL DESCRIPTION OF THE INVENTION

The present invention relates to a tunneling system, notably for mine galleries or roads.

The digging of subterranean galleries implies three distinct operations which, conventionally, are carried out successively, namely working or cutting, removal of the dug earth and support.

Cutting has been mechanised by the use of cutting tools mounted on a chain or on a drum and associated with a frame advanceable continuously. It is also known to mechanise the removal of dug earth by mechanical scraper arms which draw them towards a conveyor belt.

However, it is still necessary to stop this continuous advance of the working face, mine face or mine head, to proceed with the installation of supporting means under the portion of the roof which has just been formed.

On the other hand, the stability of the whole against the reaction forces which are exerted on the cutting tool is essentially ensured by the weight of the frame. Now this frame is generally of moderate height and the tool is articulated to it at a relatively low point, so that the reaction forces tend to rock the unit. Without giving considerable weight to the frame, which is moreover prejudicial and expensive, the stability of the unit is hence precarious, and notably necessitates a limitation in the installed power. In addition, only a slight clearance between the floor and the machine exists so that it is difficult to introduce therein an independent cuttings removal member. This member is then incorporated in the machine and prevents any access to the mine face.

It is an object of the present invention to provide a tunneling system which enables the support of the roof without interruption of the cutting operation, which offers complete stability, which enables the installed power for the cutting to be notably increased, and which offers a wide clearance above the floor to install conveniently an independent dug earth removal member, enabling easy access to the mine face.

According to the invention, a tunneling system for digging subterranean galleries comprises a cutting tool articulated to a frame, and mounted so as to be movable along the height of the mine face. This frame is provided with ground support means and with propulsion means to follow the advance of the cutting, and the system is characterised in that the articulation point of the cutting tool is situated in the upper half of the system in operating position.

This position enables a very considerable free space to be preserved beneath the machine. As a result moreover, there is a cutting tool path such that the mine face has a slope closer to that of the natural slope, which reduces the risks of cave-ins or rock-falls.

According to an additional feature of the invention, the articulation point of the cutting tool is situated on a member movable with respect to the frame and capable of being moved in a direction substantially parallel to the direction of advance.

The cutting phase proper, corresponding to the path of the tool, is preceded by a phase of advance of the tool into the mine face. Due to the aforesaid arrangement, this advance is carried out not by an advance of the frame, but by the movable member, the frame remaining solidly supported on the floor and on the roof. Stability is thus better assured during this phase.

According to another feature of the invention, the shaft bearing the cutting tool is mounted on two bearings of which one is movable vertically to give the tool an oblique track in a pre-determined direction.

When, in a sloping stratified deposit, a tunnel is dug in a direction substantially perpendicular to the line of greatest slope of the layers, it is advantageous, to reduce the risks of cave-ins or rock-falls, to give the roof of the tunnel a cant corresponding to the slope of the layers. The aforesaid feature enables this cant to be formed.

According to an advantageous feature of the invention, the frame is provided with at least one support device movable on the roof of the tunnel enabling the advance of the frame in the course of the digging operation.

This arrangement has the double advantage of forming beneath the roof of the tunnel a support advancing with the whole of the system in proportion with the cutting, and, in cooperation with the floor support means, to produce a true embedding of the system in the tunnel, preserving it from any tilting.

Preferably, each roof support device is articulated to the frame through two substantially rectangular axes of rotation, so as to accomodate alignment faults of the roof.

To ensure the support, each roof support device is advantageously connected to a jack.

According to a first embodiment of the invention, each roof support device comprises a caterpillar track which is supported against the roof.

Each caterpillar track comprises at least one caterpillar cooperating with a guide path connected to a member through a double articulation with two swing axes, substantially rectangular, enabling inequalities in the surface of the roof to be taken up.

Similarly, the floor support means comprise two caterpillar tracks arranged laterally.

In this embodiment, the propulsion means comprise a drive member with linear movement of which a fixed part is connected to the frame, and of which a movable part cooperates with a rack formed in the floor support caterpillar, the path of this member corresponding to a step in the advance of the cutting tool.

In the same way as the roof support caterpillar tracks, the floor support caterpillar tracks each comprise, preferably, at least one caterpillar cooperating with a guide path connected to the frame through a double articulation with two substantially rectangular swing axes, to take up uneveness in the floor.

According to a preferred embodiment of the invention, one of the floor support caterpillar tracks is connected to the frame through a substantially horizontal articulation axis and perpendicular to the direction of advance.

This degree of freedom enables the application of the two caterpillars to the floor to be ensured, even in the case of a fault in the general flatness of the latter.

According to a further improved feature of the invention, the frame comprises a flat cross piece located at the level of the floor support caterpillar track and provided with liftable inclined planes to facilitate the crossing thereof.

The system is thus provided with an upper cross-piece and a lower cross-piece, which improves its rigidity. On the other hand, the embodiment indicated introduces no impediment to access to the mine face or to the passage of dug earth removal mechanisms.

According to a second embodiment of the invention; the roof support device comprises at least one sliding member articulated to the frame and provided with shoes to cooperate with the beams held applied to the roof by said member.

These beams play the role of slide path for the frame and ensure at the same time the support of the roof immediately behind the mine face.

The sliding member then comprises advantageously retractable feet to take support on the roof and disengage the beams in order to advance them on each advance step of the digging.

Similarly, the frame comprises slide shoes to cooperate with the support beams placed laterally on the floor.

In this embodiment, the advance means comprise a drive member with linear movement of which a fixed part is connected to the frame, and of which a movable part is connected to a support-beam.

In the same way as for the roof beam, the frame comprises retractable feet to become supported on the floor and disengage the support beams, to advance them on each step of advance of the digging.

In the case of digging a tunnel with curvilinear cross-section, the invention provides for the roof support devices to be arranged obliquely to take support on the roof of such a tunnel.

The cutting tool then comprises a truncated cone furnished with tools mounted at the end of a shaft connected to the chassis through an articulation enabling angular movement of the arm in two substantially perpendicular planes.

The composition of these two movements enables the curvilinear movements to be realised corresponding to the profile of the tunnel.

Preferably, the articulation of the arm of the frame is mounted slidably on a substantially horizontal cross-member of the frame.

It is thus possible to utilise a relatively short arm, such that the path of the tool has an accentuated curve, and compensates for the curvature which results therefrom on the mine face through operations led successively by placing the articulation of the arm at different points of the cross piece.

Other features and advantages of the invention will emerge also from the detailed description which follows; this relates to preferred embodiments of the invention given with reference to the accompanying drawings, purely by way of non-limiting examples.

In the drawings:

FIG. 1 is a view in longitudinal section of a first embodiment of a system according to the invention, along the line I—I of FIG. 2, FIG. 2 is a view in section along the line II—II of FIG. 1, FIG. 3 is a view along the line III—III of FIG. 2, FIG. 4 is a view in section along the line IV—IV of FIG. 1, FIG. 5 is a view along the line V—V of FIG. 1, FIG. 6 is a view in section along the line VI—VI of FIG. 1, FIG. 7 is an enlarged view of a part of FIG. 1, FIG. 8 is a view in partial longitudinal section similar to FIG. 1, of a particular embodiment, FIG. 9 is a view along the line IX—IX of FIG. 8, FIG. 10 is a rear transverse view of the system in a second embodiment of the invention, FIG. 11 is a view along XI—XI of FIG. 10, FIG. 12 is a sectional view along the line XII—XII of FIG. 10, FIG. 13 is a longitudinal sectional view similar to FIG. 1, of a modification of this embodiment, FIG. 14 is a view in transverse section of the system of another embodiment of the invention, FIG. 15 is a section view along XV—XV of FIGS. 14 and 16, FIG. 16 is a sectional view along XVI—XVI of FIG. 15, FIG. 17 is a view in longitudinal section of a system according to the invention, in a version designed for the digging of galleries with curvilinear section, FIG. 18 is a rear transverse view along XVIII—XVIII of FIG. 17, FIG. 19 is a sectional view along XIX—XIX of FIG. 18, FIG. 20 is a sectional view along XX—XX of FIG. 17, and FIG. 21 is a view along the line XXI—XXI of FIG. 17.

DESCRIPTION OF PREFERRED EMBODIMENTS

Figure 1:
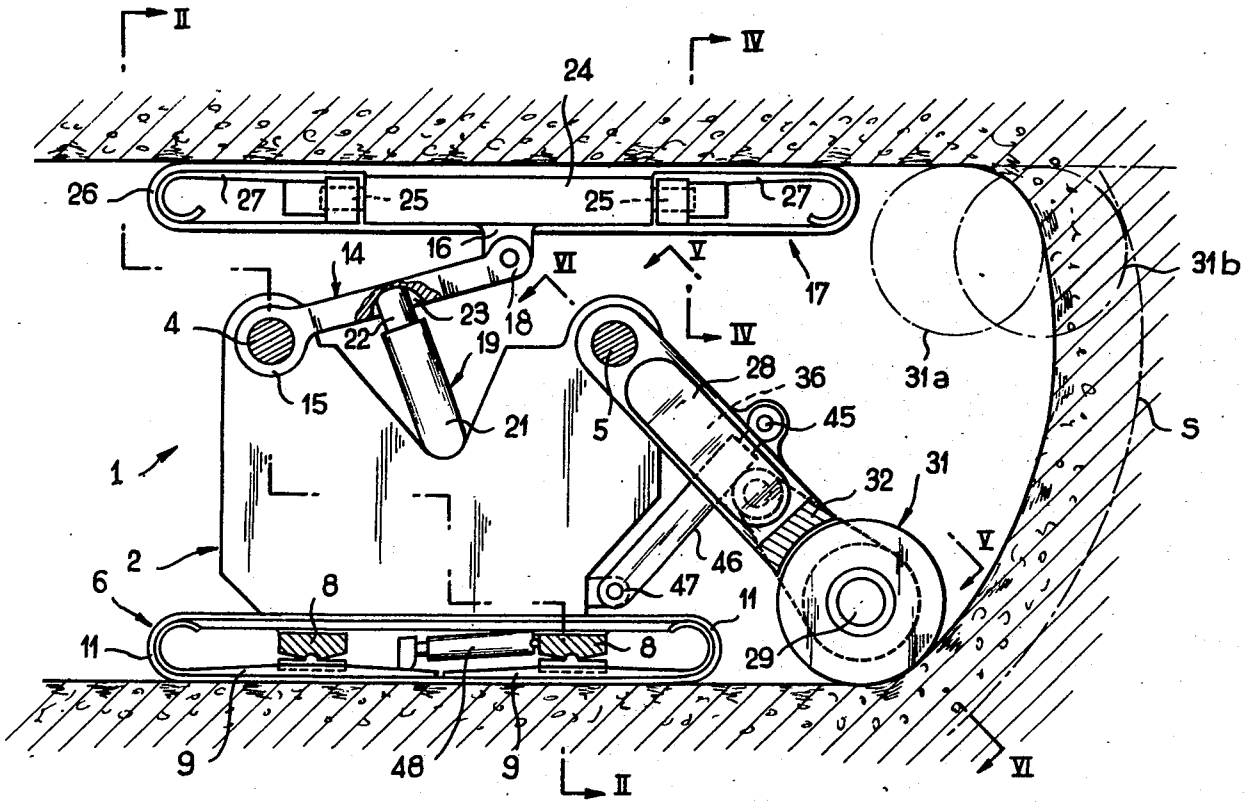
Figure 2:
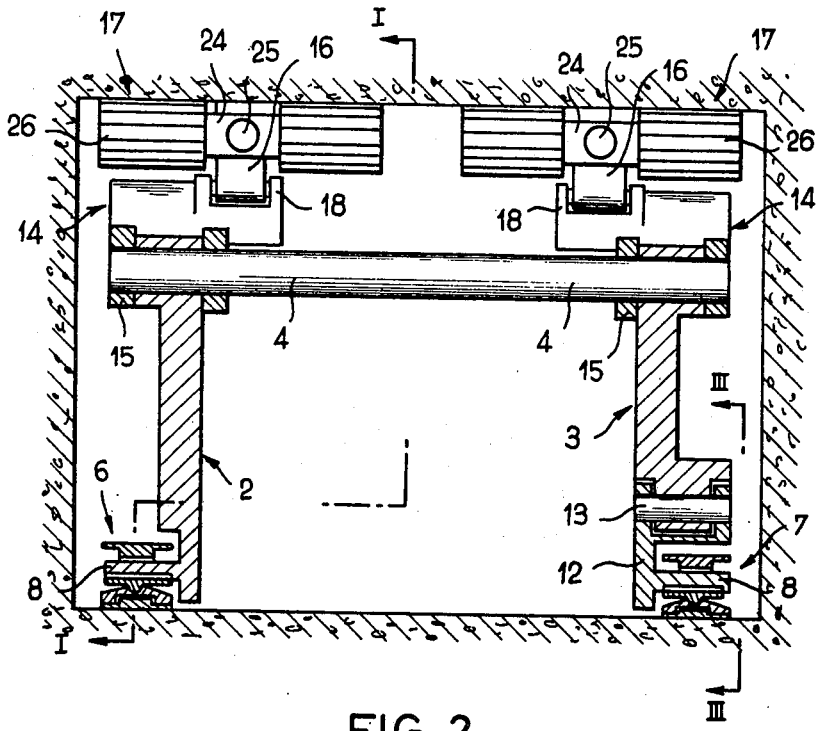
Figure 3:
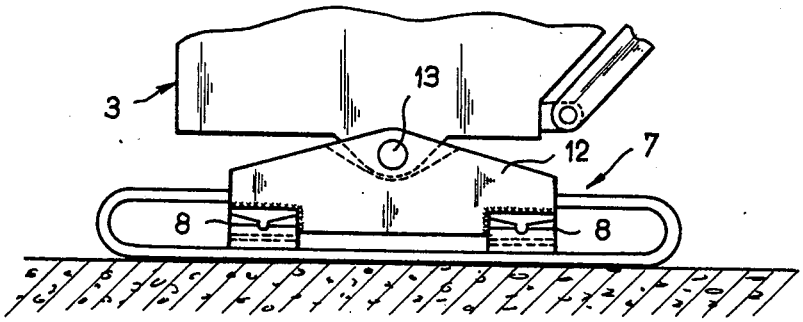

Refering to FIGS. 1 to 7, the digging or excavation system comprises a frame 1 composed of two lateral flanges 2, 3 connected together through shafts 4, 5 and each resting on a caterpillar track, respectively 6, 7.

The flange 2 is connected to the track 6 through two suspension devices 8 each composed, in a manner known in itself, of two cylindrical discs staged and perpendicular to one another, cooperating with complementary female bearings (FIGS. 1 and 2), so as to procure two degrees of freedom between the flange 2 and the guide 9 of the caterpillars 11.

The flange 3 is connected to the track 7 in substantially the same way, but, in addition, a member 12 which bears suspension devices 8 is articulated to the flange 3 through a substantially horizontal shaft 13 (FIGS. 2 and 3), so that the track 7 as a whole can oscillate in a vertical plane parallel to the direction of advance of the system. It is thus possible to obtain good simultaneous seating of the two tracks 6 and 7, even if the ground has an uneven surface.

Two arms 14 are each articulated, on the one hand, to the shaft 4 through a yoke 15 and, on the other hand, to a member 16 of a caterpillar track 17 through a yoke 18. Jacks 19, whose body 21 takes a ball-joint support in the thickness of the flanges 2 and 3, and whose rod 22 takes also a ball joint support in a cavity 23 of each arm 14, are arranged so as to repel the arms 14 upwards to apply the tracks 17 to the roof of the tunnel.

Each of the tracks 17 comprises a chassis 24 articulated to the member 16 through journals or trunnions 25 whose axis is substantially parallel to the direction of advance of the system.

Each of the chasses 24 bears two caterpillars 26 through suspension devices 8 with two rectangular swing (FIG. 4) and guide axes 27.

The caterpillars 26 are provided sufficiently wide to cover a considerable portion of the roof and ensure effective support thereof.

The shaft 5, which is situated, like the shaft 4, in the upper half of the unit, bears two rotary arms 28 which serve as a bearing, through their other end, to the shaft 29 of a cutting drum 31, and are joined by a cross-piece 32.

The drum 31 is composed, notably, of helical sheet metal element 33, fixed to a rotary sleeve 34 fast to the shaft 29, and which carries, on its edge, cutting tools 35 (FIGS. 5 and 6). The helix has, on each side of the drum, pitches in opposite directions, so as, in cooperation with the sense of rotation of the drum, to bring the dug earth to the middle longitudinal plane of the system.

On each arm 28 is fixed a reducing gear unit 36 which, through a three pinion gear train, 37, 38, 39, acts on the shaft 29. In line with each gear train, the helical sheet metal element 33 is interrupted and replaced by a cutting chain 41, also provided with cutting tools 35, and resting on a casing 42 enveloping the three pinions. Two drive nuts 43, 44 are fast to the sleeve 34 and engage the chain 41.

Each arm 28 is connected by an articulation 45 to the rod of a jack 46 articulated on the other hand to a yoke 47 fast to the corresponding flange of the frame 1.

In each of the ground support caterpillar tracks 6 and 7, a jack 48 is articulated to one of the suspension devices 8, and its rod bears a claw 49 which can become engaged through gravity in notches 51 each formed in a link of the caterpillar 11 (FIG. 7). The operation of the jack thus enables the advance of the system through the caterpillars.

To operate the system thus described, the cutting drum is brought into the upper position 31*a* (FIG. 1) by means of the jacks 46, and it is rotated by means of the gear-reducing units 36.

Then, the jacks 19 being actuated so as to apply the upper tracks 17 to the roof, the whole of the system is caused to advance by means of the jacks 48. During this advance, the drum 31 digs into the earth and the advance is stopped when it has arrived at 31*b*.

Once this advance has been effected, the jack 46 is retracted, which causes the drum 31 which envelopes the surface S marked in mixed line to descend, and the descending movement is stopped when the drum has reached the level of the floor.

Then, the drum is raised again up to the roof, that is to say into the position 31*b*, and a further advance of the unit is caused.

During this advance, the caterpillars are applied exactly on the ground and on the roof, even in the case of a fault of flatness or irregularities. Due to the articulation 13 of the member 12, the lower caterpillars are not, in fact, obliged to remain in the same plane. In addition, the articulated fastening of the upper caterpillar tracks around the journals 25, enables these tracks to mate the irregularities of the roof. Finally, the suspension arrangements 8 with two articulation axes enable each caterpillar to mate the small rugosities independently.

During all these operations, the upper caterpillars widely applied to the roof procure a sufficient temporary support which can be made permanent by a team working confortably immediately behind the system and intervening as soon as a further advance has freed an additional portion of the roof.

In addition, the manner in which the system is embedded between the ground and the roof enables, without loss of stability, the placing of the shaft 5 in a relatively high position, so that the sweeping of the drum 31 leaves a mine face S which is relatively close to the natural slope, or at least facing generally upwards, which is an arrangement resisting earth falls of the mine face.

Finally, this overhead position of the shaft 5, as well as the shaft 4, frees a wide passage (FIG. 2) for any removal machine for the dug earth.

Figure 9:
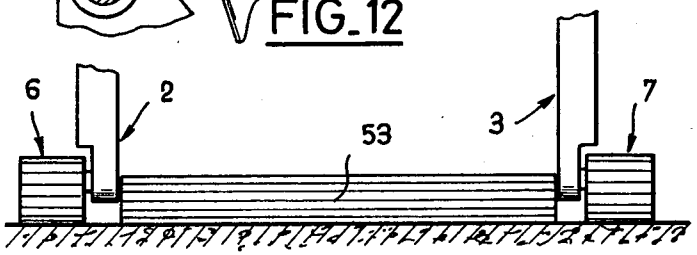
Figure 8:
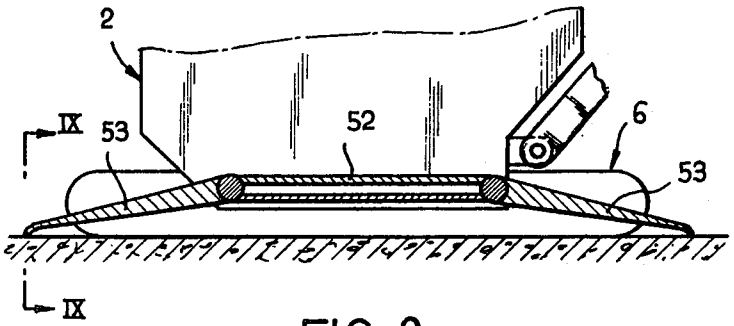

According to another embodiment of the invention, the flanges 2 and 3 of the frame 1 are rigidly united by a flat cross-piece 52 situated in the vicinity of the ground level (FIGS. 8 and 9). Articulated lift-bridges 53, raisable by jacks (not shown), can rest on the ground to enable easy passage for personnel and loads.

This arrangement offers a better transverse rigidity of the whole of the frame. Except for a special construction, it is not compatible with the production of the articulated member 12 for the track 7.

Figure 10:
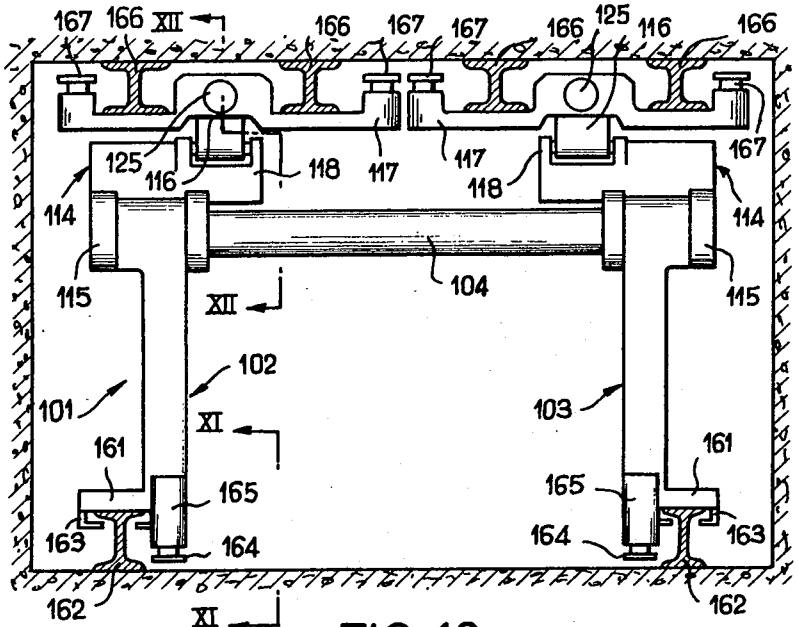
Figure 11:
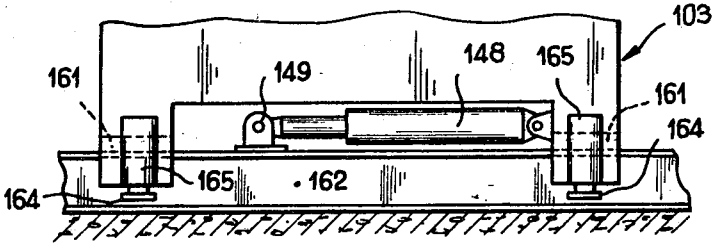
Figure 12:
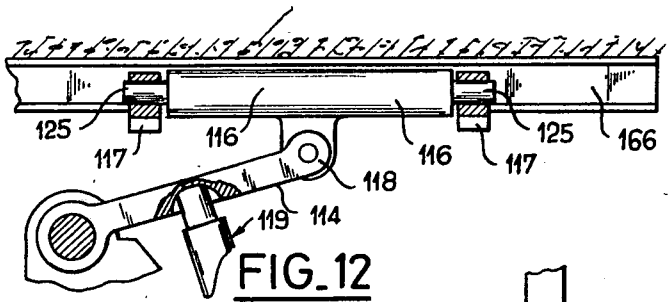

There will now be described, with reference to FIGS. 10 to 12, a second embodiment of the invention.

In this embodiment, a frame 101 is composed of two lateral flanges 102, 103 connected together by a shaft 104 and by a shaft 105, not shown, similar to the shaft 5 of the preceding construction and playing the same role.

At their lower part, the flanges 102, 103 bear sliding shoes 161 provided to cooperate with profiled irons 162 arranged on the ground in the direction of advance of the system, to constitute support-beams. Hooks 163 are provided to avoid derailment. On each flange, two retractable feet 164 controlled by jacks 165 enable the frame 101 to rest on the ground to relieve the profiled elements 162.

Two arms 114 are articulated by yokes 115 on the shaft 105 and each bears, through a yoke 118, at their other end, a sliding member 116. On each member are articulated by trunnions 125 double sliding shoes 117 which cooperate with profiled elements 166, holding them applied to the roof of the gallery.

The arms 114 are actuated by jacks 119, as in the preceding construction, to permit the application upwards of the shoes 117.

Each of the shoes 117 bears two retractable feet 167 actuated by jacks to be supported on the roof and to enable the profiled elements 166 to be relieved.

At the upper part of each of the flanges 102, 103, a jack 148 has its body articulated to the flange and its rod articulated to a yoke 149 fixed to the corresponding profiled element 162.

It will be understood that the extension of the jack causes the sliding of the frame on the profiled elements 162.

The cutting means are the same as in the preceding embodiment and operate in the same way.

To cause the frame to advance, the jack 148 is actuated to cause the frame to slide on the profiled elements 162, over a distance corresponding to a pre-determined step of the advance.

Lastly, the retractable feet 164 and 167 are extended so that the frame is only supported on the ground and on the roof by these feet, and the jack is actuated in the other direction to bring back the profiled elements 162. It is also possible to advance profiled elements 166 which constitute a movable support, and a fixed support is arranged behind these.

The system being always firmly embedded in the gallery by the gripping of the jack 119, the cutting operation is effected, then the sliding manoeuvre is repeated.

There will now be described an important improvement of the invention, with reference to FIG. 13, which repeats a part of FIG. 1 in this other embodiment.

Two rotary arms 228 bearing a cutting drum 231 are articulated not on the flanges 202, 203 of the frame, but on movable members 268 themselves articulated on the respective flanges. These members may be moved in a vertical plane parallel to the direction of advance by respective jacks 269 fixed also to the flanges.

The arms 228 are actuated, as in the preceding embodiment, by jacks 246.

Figure 13:
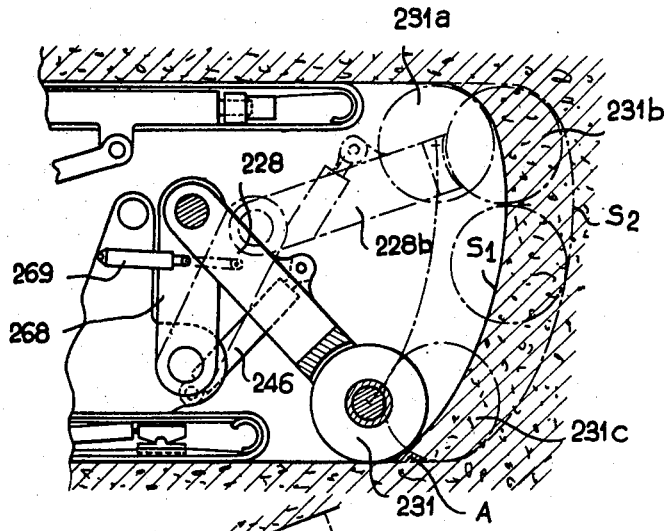

The gallery having a working face S 1 and the system having been brought into the position of the FIG. 13, that is to say the jack 269 retracted to bring back the arms 228 and the drum 231, this drum is raised to 231*a* by operating jacks 246.

Then, by extending the jacks 269, the arms 228 are moved forwards and the drum 231, at 228*b* and 231*b* up to a position defining fresh working face S 2. The drum is then lowered to 231*c* to form the front S 2. Lastly, by retracting the jacks 269, the drum is brought back to the position 231.

With respect to the preceding embodiment, this arrangement has the advantage of advancing the drum from 231*a* to 231*b*, whilst the system is stopped and, consequently, stable and firmly embedded in the gallery. A floor which is more regular is also formed by completely cutting off the hatched part A.

Once the aforesaid cycle has been carried out, the system is advanced by keeping the jacks 269 retracted, until the drum comes into position 231*c*, and the same operations as above are repeated.

Figure 14:
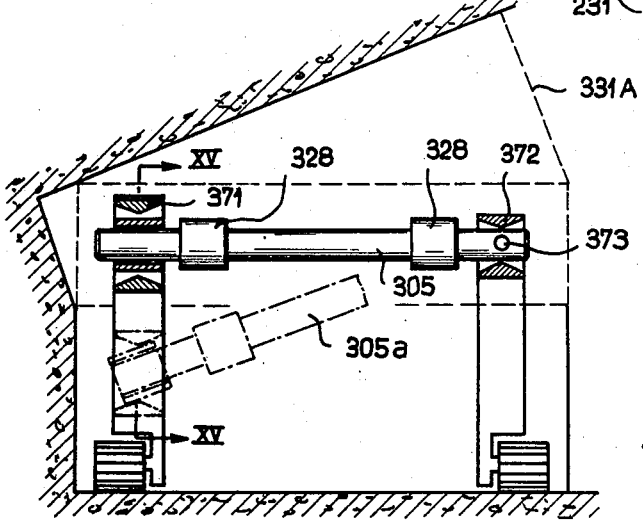

Another embodiment of the invention will now be described with reference to FIGS. 14 to 16.

According to this embodiment, the shaft 305 bearing the arm 328 of the cutting drum is mounted on two bearings of which one 371 is slidably mounted on the flange 302 of the frame, the other 372 being fixed. The shaft 305 is fixed in rotation, but can pivot around a trunnion 373 located in the bearing 372, so that the shaft can come to occupy an oblique position 305*a*. For this purpose, the bearings 371 and 372 are bi-conical to enable the angular movement provided.

Figure 15:
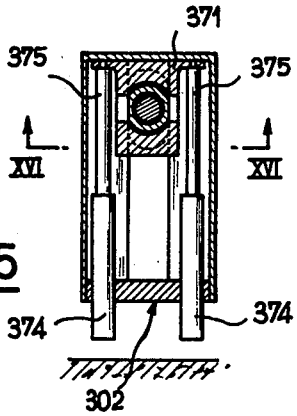
Figure 16:
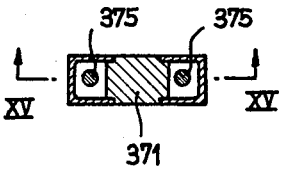

To carry out this operation, two jacks 374 have their bodies fixed to the frame 302, whilst their rods 375 are applied to the bearing 372 (FIG. 15). By bringing the bearing 372 into the low position 372*a*, the shaft 305 comes into oblique position 305*a*, which enables the cutting drum also to be lifted into the oblique position 331*a*, to dig an oblique roof.

This arrangement finds its advantage when a road has to be dug in an inclined seam, the road advancing beneath a bed without cutting it. It is then possible, whilst giving the road a horizontal floor (or at least without cant) to give it a roof constituted by the selected bed most of the time for its mechanical properties.

Another embodiment of the invention designed for digging a road with a curvilinear section will now be described with reference to FIGS. 17 to 21.

A frame 401 comprises two flanges 402, 403, mounted on caterpillar tracks 406, 407 respectively, resting on the ground and similar to those of the preceding embodiments.

A shaft 404 bent into a reverse V is fixed at its respective ends in the flanges 402, 403, and bears on its inclined parts bearings 415 of arms 414 articulated on caterpillar tracks 417 applied to the roof of the gallery. These tracks are similar to the tracks 17 of the first embodiment described and their type of fastening to the system is similar.

On a transverse shaft 481 connecting the two flanges is fixed a support 432 on which two racks 419 are supported whose rods 422 are supported on the arms 414 to urge the caterpillar tracks 417 against the roof of the gallery An arm 483 forms a consolidating link between the arm 404 and the arm 481.

Figure 17:
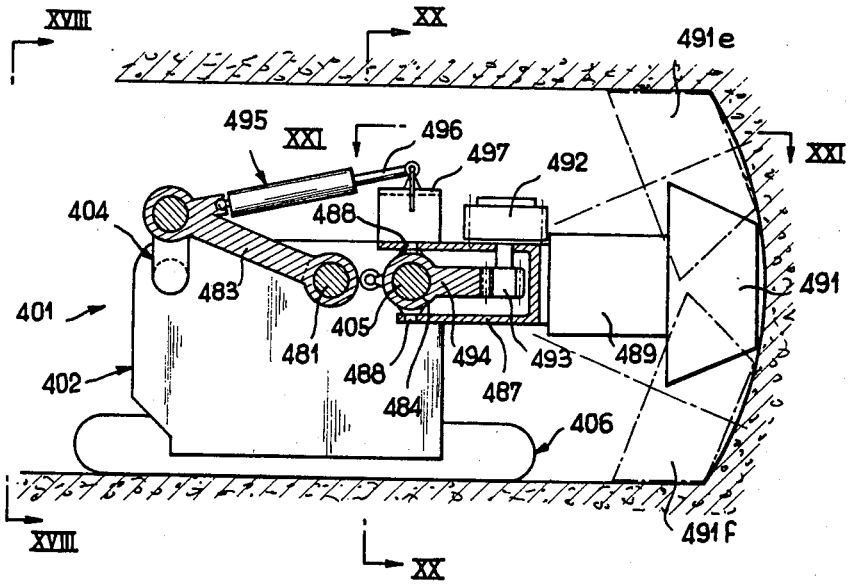
Figure 21:
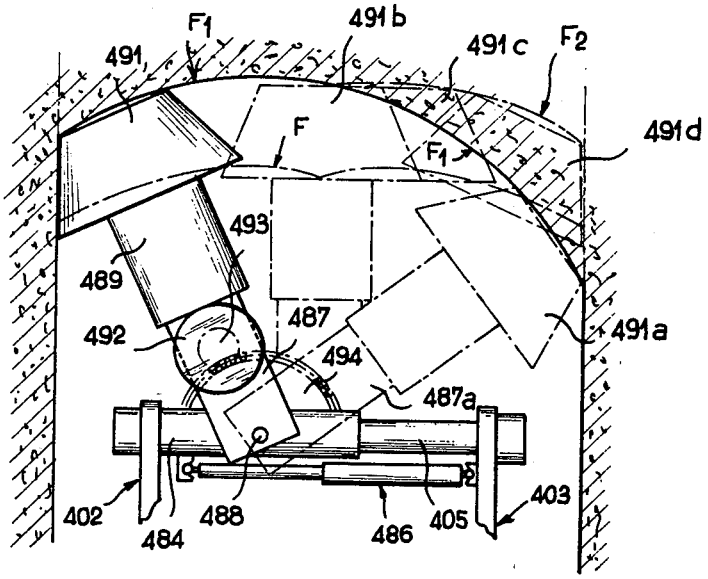

At the front of the frame, a horizontal transverse shaft 405 bears a slide 484 (FIGS. 17, 20, 21). This slide is fixed to the rod 485 of a jack 486 whose body, parallel to the shaft 405, is fixed to the flange 403, enabling the slide to be moved along the shaft 405.

A yoke 487 is fixed to the slide 484 through two pivots 488 constituting a vertical rotary axle. This yoke bears a gear reducing unit 489 at the end of the shaft to which a frustoconic cutting tool 491 is fixed.

A hydraulic motor 492 is fixed to the yoke 487 and actuates a gear 493 which enmeshes with a toothed section 494 fast to the slide 484.

Finally, a jack 495 has its body fixed to the arm 483 through an articulation and its rod 496 fixed, also by an articulation, to a connecting part 497 to the yoke 487. The movements of the rod of this jack thus enable the slide 484 to be rotated around the shaft 405. This movement is permitted in any axial position of the slide on the shaft, due to the articulated connections of the jack 495.

In operation, the advance of the system and its solid embedding between the floor and the roof are carried out substantially in the same way as has been described above.

To start a fresh cutting step, procedure is as follows:

The face to be cut being along F (FIG. 21), the slide 484 is placed at the left-hand end of the shaft 405, the yoke 487 bearing the tool 491 being oriented towards the right (along 487*a*, 491*a*).

The tool being in rotation under the action of the motor reducing gear 489, the yoke 487 is then rotated by means of the hydraulic motor 492 in anti-clockwise direction to bring it into the position 491, starting the working face, along F1. It is noted that, during this development, the tool does not work through its angular edge, but through its lateral surface.

The slide is then moved towards the right keeping the yoke 487 parallel to the direction of advance, the tool occupying successively the positions 491*b* and 491*c*. Then, the slide being at the right-hand end of travel, the yoke 487 is rotated in clockwise direction, to bring the tool into its final position 491*d*. In this way a cut along F2 is produced. The combination of the lines F1 and F2 gives the fresh working face obtained.

This operation is recommenced at different levels, such as 491*e* and 491*f* (FIG. 17), so as to cut the whole working face, by operating the jack 489.

Finally, the yoke 487 can advantageously be given a circular movement enveloping a cone to achieve the circular shape of the gallery.

Then, the whole of the system is advanced by a system equal to the depth of the cut which has just been carried out.

In this embodiment, as in the preceding one, the transverse shafts are placed at a rather high level, normally in the upper half of the galery, which frees a large space for removing dug earth.

One of the advantages of this system resides in the fact that, when a fresh working face is started, the tool practically never works through its edge alone, which would have the effect of deteriorating the cutting elements, but through the whole of its lateral surface.

As in the preceding embodiments, the cutting, support and dug earth removal operations can be carried out simultaneously and uninterruptedly.

Of course, the invention is not limited to the examples described, but also covers any constructive modification within the scope of the technician skilled in the art.

I claim:

1. In a tunneling system, comprising a cutting tool articulated on a frame and mounted so as to be movable along the height of the mine face, said frame being provided with ground support means and with propulsion means for following the progress of the cutting, the articulation point of the cutting tool being situated in the upper half of the system in any operating position; the improvement wherein the frame comprises two upstanding lateral flanges with a free space between them, the cutting tool being mounted for vertical swinging movement on a horizontal shaft that is supported at its ends by said flanges, the space below that portion of the shaft that is between its supported ends being open down to the ground to give access to the mine face for staff and any apparatus.

2. System according to claim 1, wherein the articulation point of the cutting tool is situated on a member movable with respect to the frame and is movable in a direction substantially parallel to the direction of advance.

3. System according to claim 1, wherein the shaft bearing the cutting tool is mounted on two bearings, one of which is movable vertically to give the tool on oblique path in a pre-determined direction.

4. System according to claim 1, wherein the frame is provided with at least one movable support device on the roof of the tunnel enabling the advance of the frame in the course of the tunnelling operation, said support device extending laterally substantially all the breadth of the tunnel.

5. System according to claim 4, wherein each support device on the roof is articulated to the frame through two substantially rectangular rotary axes.

6. System according to claim 4, wherein each roof support device is connected to a jack to ensure the support.

7. System according to claim 4, wherein each roof support device comprises a caterpillar track.

8. System according to claim 7, wherein each caterpillar track comprises at least one caterpillar cooperating with a guide path joined to a member through a double articulation with two substantially rectangular swing axes.

9. System according to claim 7, wherein the ground support means comprise two caterpillar tracks arranged laterally.

10. System according to claim 9, wherein the propulsion means comprise a drive member with a linear movement of which a fixed part is connected to the frame and of which a movable part cooperates with a rack formed in the ground support caterpillar.

11. System according to claim 9, wherein the caterpillar tracks cooperate with a guide path connected to the frame through a double articulation with two substantially rectangular swing axes.

12. System according to claim 9, wherein one of the ground support caterpillar tracks is connected to the frame through an articulation of substantially horizontal axis and perpendicular to the direction of advance.

13. System according to claim 9, wherein the frame comprises a flat cross-piece situated at the level of the ground support caterpillar tracks and provided with liftable inclined planes to facilitate the crossing.

14. System according to claim 4, wherein the roof support devices are arranged obliquely to take support on the roof of a tunnel with a curvilinear cross section.

15. System according to claim 14, wherein the cutting tool comprises a truncated cone provided with tools mounted at the end of a shaft connected to the frame through an articulation enabling angular movements of the arm in two substantially perpendicular planes.

16. System according to claim 14, wherein the articulation of the arm on the frame is mounted to slide on a substantially horizontal cross member of the frame.

* * * * *